US007798596B2

(12) United States Patent
Ishizaki

(10) Patent No.: US 7,798,596 B2
(45) Date of Patent: Sep. 21, 2010

(54) INKJET RECORDING APPARATUS

(75) Inventor: Sunao Ishizaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 148 days.

(21) Appl. No.: 12/251,508

(22) Filed: Oct. 15, 2008

(65) Prior Publication Data

US 2009/0046121 A1 Feb. 19, 2009

Related U.S. Application Data

(62) Division of application No. 11/053,960, filed on Feb. 9, 2005, now Pat. No. 7,452,049.

(30) Foreign Application Priority Data

Aug. 18, 2004 (JP) ..... 2004-238221
Aug. 18, 2004 (JP) ..... 2004-238222

(51) Int. Cl.
*B41J 29/393* (2006.01)
*B41J 2/045* (2006.01)

(52) U.S. Cl. ..... 347/19; 347/68

(58) Field of Classification Search ..... 347/5, 347/9, 19, 68–72; 324/76.49, 725, 727; 310/316.01
See application file for complete search history.

(56) References Cited

U.S. PATENT DOCUMENTS

| | | | |
|---|---|---|---|
| 4,034,380 | A | 7/1977 | Isayama |
| 4,172,991 | A | 10/1979 | Akamatsu et al. |
| 4,467,271 | A | 8/1984 | Ruckenbauer et al. |
| 5,500,657 | A | 3/1996 | Yauchi et al. |

FOREIGN PATENT DOCUMENTS

| | | |
|---|---|---|
| JP | 51-117530 | 10/1976 |
| JP | 62-95225 | 5/1987 |
| JP | 10-305590 | 11/1998 |
| JP | 2000-318183 | 11/2000 |
| JP | 2000-355100 | 12/2000 |
| JP | 2003-118093 | 4/2003 |

*Primary Examiner*—Stephen D Meier
*Assistant Examiner*—Geoffrey Mruk
(74) *Attorney, Agent, or Firm*—Fildes & Outland, P.C.

(57) ABSTRACT

An ink non-ejection detecting circuit device for an inkjet recording apparatus is disclosed which comprises a bridge circuit including a piezoelectric head having a piezoelectric element, a first resistor connected in series to the piezoelectric head, a capacitor provided outside the piezoelectric head, and a second resistor connected in series to the capacitor. A differential voltage that appears between the piezoelectric head and the first resistor and between the capacitor and the second resistor is amplified, so that the acoustic-system admittance of the piezoelectric head can be detected with a high SN ratio.

9 Claims, 14 Drawing Sheets

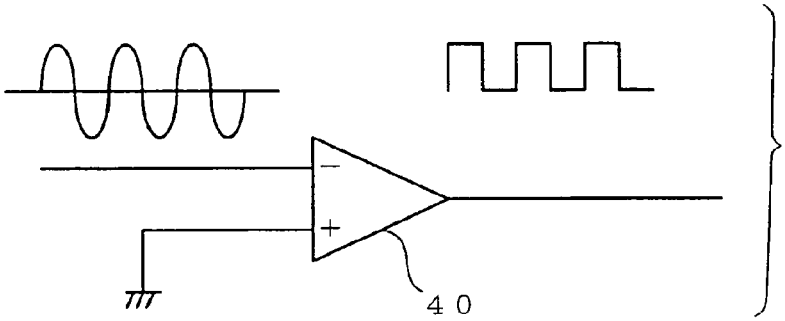
FIG. 3A
FIG. 3B
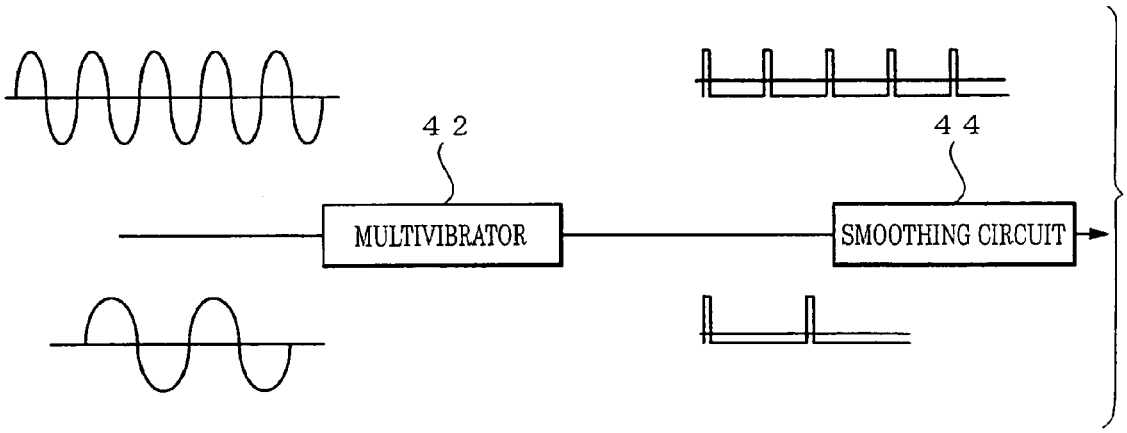

INKJET RECORDING APPARATUS

CROSS-REFERENCE TO RELATED APPLICATIONS

This application is a division of U.S. application Ser. No. 11/053,960 filed Feb. 9, 2005, and claims priority under 35 USC 119 from Japanese Patent Applications Nos. 2004-238221 and 2004-238222, the disclosures of which are incorporated by reference herein.

BACKGROUND OF THE INVENTION

1. Field of the Invention

The present invention relates to an ink non-ejection detecting circuit of an inkjet printing apparatus, and a method for inspecting an inkjet recording apparatus, and more particularly it pertains to an ink non-ejection detecting circuit of an inkjet printing apparatus using piezoelectric elements for ejecting inks, a method for inspecting such an inkjet recording apparatus, and an inkjet recording apparatus.

2. Description of the Related Art

In recent years, so-called inkjet recording apparatuses in which inks are ejected from ink ejection nozzles are employed with numerous printers by virtue of the fact that they are featured by compactness and low cost. Of the inkjet systems, it is the piezo inkjet system in which ink ejection is carried out due to deformation of a piezoelectric element that is dominantly utilized from the standpoints of high resolution and high-speed printing performance.

In an inkjet recording apparatus using vibration energy of a piezoelectric element, it is arranged such that a piezoelectric element provided in an ink flow passage is vibrated in accordance with image information so that an ink droplet is formed due to deformation of the piezoelectric element. By controlling the waveform of a voltage applied to the piezoelectric elements, the meniscus at each ink ejection nozzle and resupply of ink after ejection can be controlled, and thus a high-frequency driving (ink ejection) and gradational recording by virtue of changing the quantity of ink droplets can be achieved.

In the operation of the inkjet recording apparatus described above, there is a likelihood that non-injection of ink will be caused because of air bubbles entering the ink supply portion from the nozzles and/or because of the ink adhered to the nozzle surface getting dried. In order to prevent such situations from occurring, it has been the usual practice that suction is frequently carried out with respect to the nozzle surface or maintenance such as wiping is serviced. Disadvantageously, this results in a useless consumption of a large amount of time and ink. Another disadvantage is that unless the maintenance is perfect, dot missing occurs, thus decreasing the quality of the printed matter.

Accordingly, it is conceivable to detect a nozzle in which ink non-ejection has occurred and perform a printing process using nozzles other than the nozzle in which ink non-ejection has occurred.

Methods for detecting a nozzle in which ink non-ejection has occurred have been proposed in JP-A Nos. 2000-355100 and 2000-318138, for example. In these methods, a nozzle in which ink non-ejection has occurred is detected based on a change of the resonance point of a piezoelectric element, and more specifically the resonance point of the piezoelectric element is detected by gradually changing the frequency.

A method for detecting a nozzle in which ink non-ejection has occurred without using a piezoelectric element as a driving source for ink ejection has been proposed in JP-A No. 2003-118093, for example.

However, the techniques disclosed in the above JP-A Nos. 2000-355100 and 2000-318138 are disadvantageous in that time is required to detect the resonance point since the resonance frequency of the piezoelectric element is detected by gradually changing the frequency.

Further, when use is made of a piezoelectric head using a piezoelectric element as a driving source for ink ejection, it is required to detect the resonance frequency of the acoustic-system admittance of the piezoelectric head comprising a piezoelectric element, a pressure chamber, an ink feed passage, and a nozzle wherein the influence of the electric-system admittance of the piezoelectric head is eliminated, in order to detect a state change due to an inflow of air bubbles and adherence of ink to the nozzle surface. The techniques disclosed in the above-mentioned JP-A Nos. 2000-355100 and 2000-318183 are problematic in that the accuracy of detection of a nozzle in which ink non-ejection has occurred is reduced because the resonance frequency of the piezoelectric element is being detected.

Another problem is such that when detecting the resonance frequency of the acoustic-system admittance of the piezoelectric head, difficulty is encountered in the detection of the resonance frequency since the SN ratio is low.

SUMMARY OF THE INVENTION

The present invention has been made in view of the above-described facts and provides an ink non-ejection detecting circuit for an inkjet recording apparatus which is capable of detecting the resonance frequency of the acoustic-system admittance of a piezoelectric head with a high SN ratio, a method for checking an inkjet recording apparatus, and an inkjet recording apparatus.

A first aspect of the present invention provides an ink non-ejection detecting circuit for inkjet recording apparatus, comprising: a bridge circuit including a piezoelectric head having a piezoelectric element, a first resistor connected in series with the piezoelectric head, a capacitor provided outside the piezoelectric head, and a second resistor connected in series with the capacitor; and a differential amplifier circuit that amplifies a differential voltage appearing between the piezoelectric head and the first resistor and between the capacitor and the second resistor. Further, it provides an inkjet recording apparatus comprising such an ink non-ejection detecting circuit.

A second aspect of the present invention provides a method for checking an inkjet recording apparatus wherein ink is ejected by a piezoelectric head having a piezoelectric element, the method comprising: forming a bridge circuit including the piezoelectric head, a first resistor connected in series with the piezoelectric head, a capacitor provided outside the piezoelectric head, and a second resistor connected in series with the capacitor; and amplifying a differential voltage that appears between the piezoelectric head and the first resistor and between the capacitor and the second resistor.

A third aspect of the present invention provides an ink non-ejection detecting circuit for an inkjet recording apparatus, comprising: a bridge circuit including a piezoelectric head having a piezoelectric element, a first resistor connected in series with the piezoelectric head, a capacitor provided outside the piezoelectric head, and a second resistor connected in series with the capacitor; a differential amplifier circuit that amplifies a differential voltage appearing between the piezoelectric head and the first resistor and between the capacitor and the second resistor; and a positive feedback circuit that adjusts a phase of the differential voltage so as to make null a phase difference between a signal for driving the bridge circuit and the differential voltage amplified by the differential amplifier circuit, thereby generating a driving signal for the bridge circuit. Further, it provides an inkjet recording apparatus comprising such a non-ejection detecting circuit.

A fourth aspect of the present invention provides a method for checking an inkjet recording apparatus wherein ink is ejected from a piezoelectric head having a piezoelectric element, the method comprising: forming a bridge circuit including the piezoelectric head having the piezoelectric element, a first resistor connected in series with the piezoelectric head, a capacitor provided outside the piezoelectric head, and a second resistor connected in series with the capacitor; forming a differential amplifier circuit that amplifies a differential voltage appearing between the piezoelectric head and the first resistor and between the capacitor and the second resistor in the bridge circuit; forming a positive feedback circuit that adjusts a phase of the differential voltage so as to make null a phase difference between a signal for driving the bridge circuit and the differential voltage; and using a signal generated by the positive feedback circuit as the driving signal for the bridge circuit.

Other aspects, features and advantages of the present invention will become apparent to a person having ordinary skill in the art from the following description taken in conjunction with the accompanying drawings.

BRIEF DESCRIPTION OF THE DRAWINGS

Preferred embodiments of the present invention will be described in detail based on the following figures, wherein:

FIGS. 3A and 3B are views useful for explaining an example of a frequency detecting unit;

DETAILED DESCRIPTION OF THE INVENTION

Embodiments of the present invention will now be described with reference to the drawings.

Figure 1:
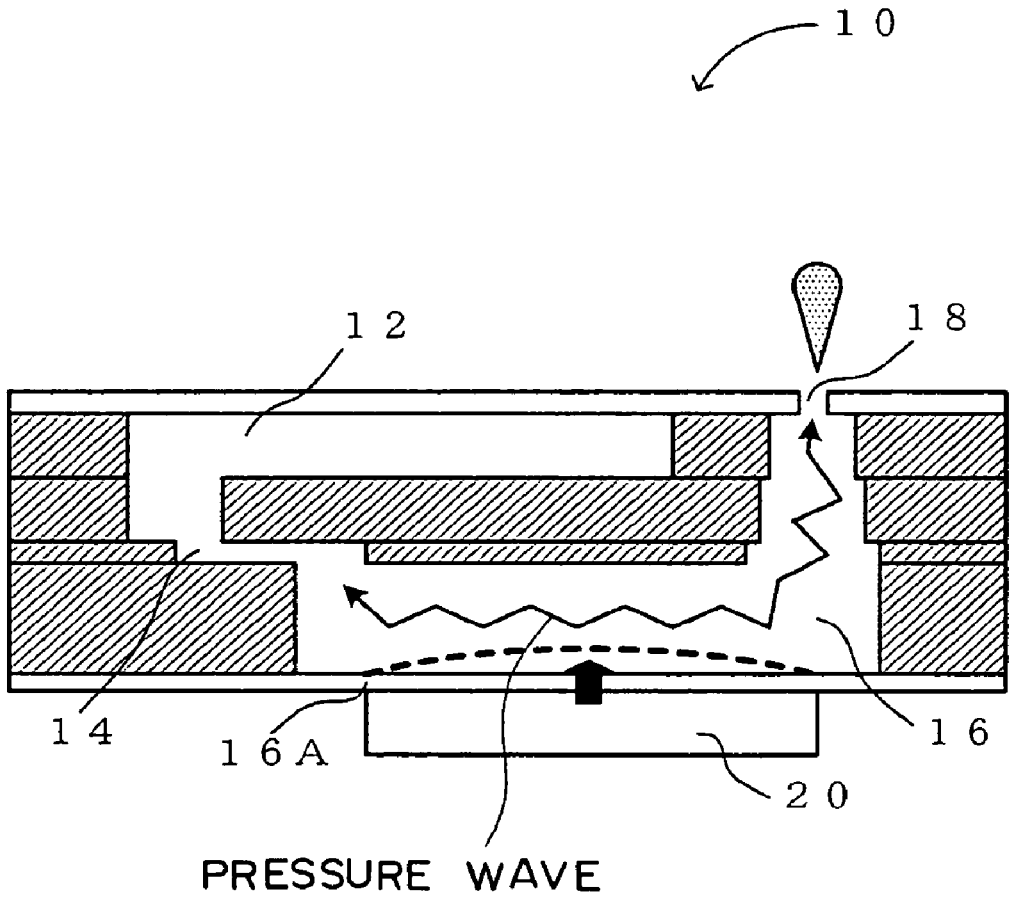
FIG. 1 is a schematic sectional view showing a head structure per nozzle of an inkjet recording apparatus according to the present invention.

FIG. 1 shows a head structure for one nozzle in the inkjet recording apparatus according to a first embodiment of the present invention.

A head 10, which corresponds to a piezoelectric head usable in the present invention, includes an ink tank 12, a feed passage 14, a pressure chamber 16, a nozzle 18, and a piezoelectric element 20.

The ink tank 12 stores an ink which is fed to the pressure chamber 16 through the ink feed passage 14 and then to the nozzle 18 via the pressure chamber 16.

The pressure chamber 16 comprises a diaphragm 16A forming a wall surface thereof. The piezoelectric element 20 is provided on the diaphragm 16A. Thus, the diaphragm 16A is vibrated by the piezoelectric element 20, and consequently a pressure wave is generated. Due to the pressure wave thus generated, the ink stored in the ink tank 12 is passed through the feed passage 14 and pressure tank 16 and ejected from the nozzle 18.

Figure 2:
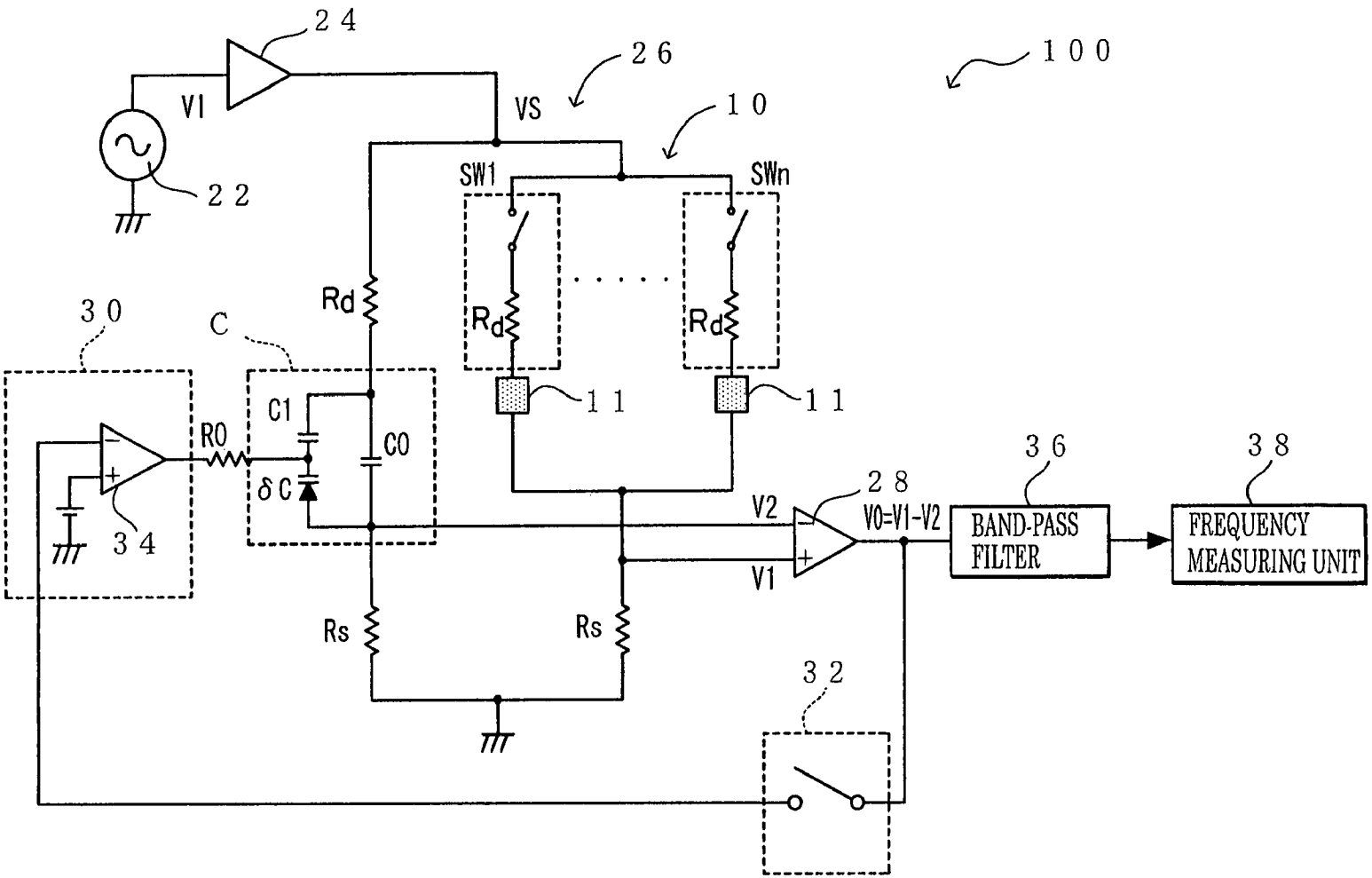
FIG. 2 is a diagrammatic view showing an ink non-ejection detecting circuit for an inkjet recording apparatus according to a first embodiment of the present invention.

FIG. 2 illustrates an ink non-ejection detecting circuit for the inkjet recording apparatus according to the first embodiment of the present invention. The non-ejection detecting circuit of the inkjet recording apparatus according to the first embodiment of the present invention is a circuit for detecting ink non-ejection from the nozzle, which may be installed in an inkjet recording apparatus, applied to an apparatus for testing manufacturing steps in the manufacture of an inkjet recording apparatus, or partially incorporated in an inkjet recording apparatus.

As shown in FIG. 2, in the ink non-ejection detecting circuit 100 of the inkjet recording apparatus, a drive circuit 24 to which an AC power source 22 is connected is connected to a bridge circuit 26 including a head 10. The head 10 comprises switches SW1-SWn each comprising an analog multiplexer including an ON resistor Rd for nozzle selection and head equivalent circuits 11 connected in series with the switches SW1-SWn, wherein the series connections of the switches SW1-SWn and the head equivalent circuits 11 are connected in parallel with each other and the number of such series connections is equal to the number of the nozzles.

The bridge circuit 26 comprises the head 10 (the ON resistors Rd of the switches SW1-SWn and the head equivalent circuits 11), a current detecting resistor Rs connected in series with the head 10, a resistor Rd identical with the ON resistor and provided outside the head 10, a capacitor C provided outside the head 10 and connected in series with the resistor Rd provided outside the head 10, and a current detecting resistor Rs connected in series with the capacitor C. The drive circuit 24 is connected between the head 10 and the resistor Rd provided outside the head 10, and a connection point between the current detecting resistors Rs is grounded. A drive voltage VS is applied from the drive circuit 24 to the bridge circuit 26.

The capacitor C comprises a variable capacitance diode δC, an electrostatic capacitance component C1 connected in series with the variable capacitance diode δC, and an electrostatic capacitance component C0 connected in parallel with the variable capacitance diode δC. The electrostatic capacitance component C1 constitutes a coupling capacitor for preventing a DC voltage applied to the variable capacitance diode δC from flowing into the bridge circuit 26.

A differential amplifier 28 is connected between the head and the current detecting resistor Rs and between the capacitor C and the other current detecting resistor Rs. A voltage V1 is applied from the connection point between the head 10 and the current detecting resistor Rs to the differential amplifier 28, and a voltage V2 is applied from the connection point between the capacitor C and the current detecting resistor Rs to the differential amplifier 28.

An automatic electrostatic capacitance adjustment circuit 30 is connected to the output of the differential amplifier 28. The output of the automatic electrostatic capacitance adjustment circuit 30 is connected to the connection point between the electrostatic capacitance component C1 and the variable capacitance diode δC via a resistor R0. Further, an operation switch 32, which controls the operation of the automatic electrostatic capacitance adjustment circuit 30, is connected between the differential amplifier 28 and the automatic electrostatic capacitance adjustment circuit 30.

More specifically, the automatic electrostatic capacitance adjustment circuit 30 comprises an inversion amplifier 34 which has a negative terminal connected to the output terminal of the differential amplifier 28 via the operation switch 32 and a positive input terminal connected to a DC power source grounded at one end. The output terminal of the automatic electrostatic capacitance adjustment circuit 30 is coupled to the resistor R0.

Further, a frequency measuring unit 38 is connected to the output terminal of the differential amplifier via a band-pass filter 36 which is adapted to pass a frequency band including at least the resonance frequency of the piezoelectric element 20. Although the filter 36 comprises a band-pass filter, it may also comprise a low pass filter or a high pass filter depending on the frequency band.

The frequency measuring unit 38 uses a frequency counter such as shown in FIG. 3A or a frequency-voltage converter such as shown in FIG. 3B, for example. In the case of the frequency counter, a sinusoidal waveform is transformed into a rectangular waveform by means of a zero-cross comparator 40, and the time between adjacent edges of the rectangular waveform is measured with a separate high-speed clock and converted to frequency. In the case of the frequency-voltage converter, a sinusoidal waveform is transformed to a pulse having a constant pulse width by means of a mono-stable multivibrator 42 which triggers at a point where the sinusoidal waveform changes from negative-going to positive-going, and the duty ratio of the pulse is proportional to the frequency of the sinusoidal waveform since the frequency of the pulse is identical with that of the sinusoidal waveform. Thus, the pulse is converted to an average voltage by a smoothing circuit 44, and a frequency is obtained with the converted voltage. Meanwhile, the frequency measuring unit 38 is by no means limited to the above-described one and may use any other type of frequency measuring means.

In the non-ejection detecting circuit 100 for the inkjet recording apparatus as constructed above, when it detects non-ejection that occurs at the head 10, a trapezoidal waveform is inputted from the drive circuit 24.

Figure 4:
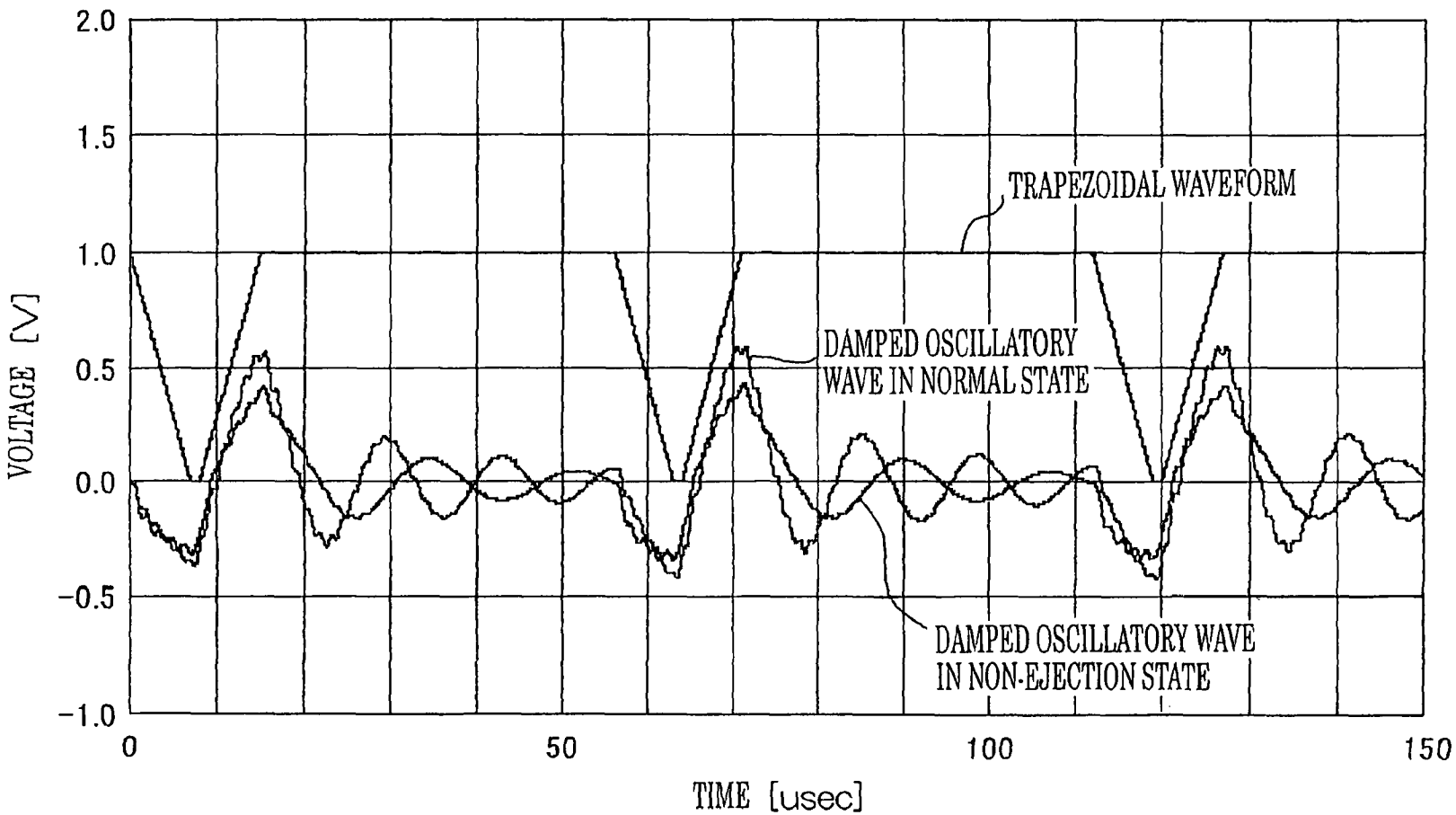
FIG. 4 is a view illustrating a waveform inputted to the ink non-ejection detecting circuit for the inkjet recording apparatus according to the first embodiment of the present invention, and a damped oscillatory wave outputted from a differential amplifier.

FIG. 4 illustrates an input waveform that can be used in the non-ejection detecting circuit 100.

An input signal provided to the non-ejection detecting circuit 100 has a trapezoidal waveform having rise and fall times that are equal to the natural period of the acoustic vibration system of the head 10 divided by an integer and a cyclic period that is an integer times as long as that of the acoustic vibration system. Although in this embodiment, a trapezoidal waveform is used, the present invention is not limited thereto but can use any periodic waveform signal having rise and fall times that are equal to the natural period of the acoustic vibration system of the head 10 divided by an integer and a period that is an integer times as high as that of the acoustic vibration system.

Description will next be made of the operation of the non-ejection detecting circuit 100 according to the first embodiment of the present invention.

First, the operational principles of the non-ejection detecting circuit 100 will be explained.

Figure 5:
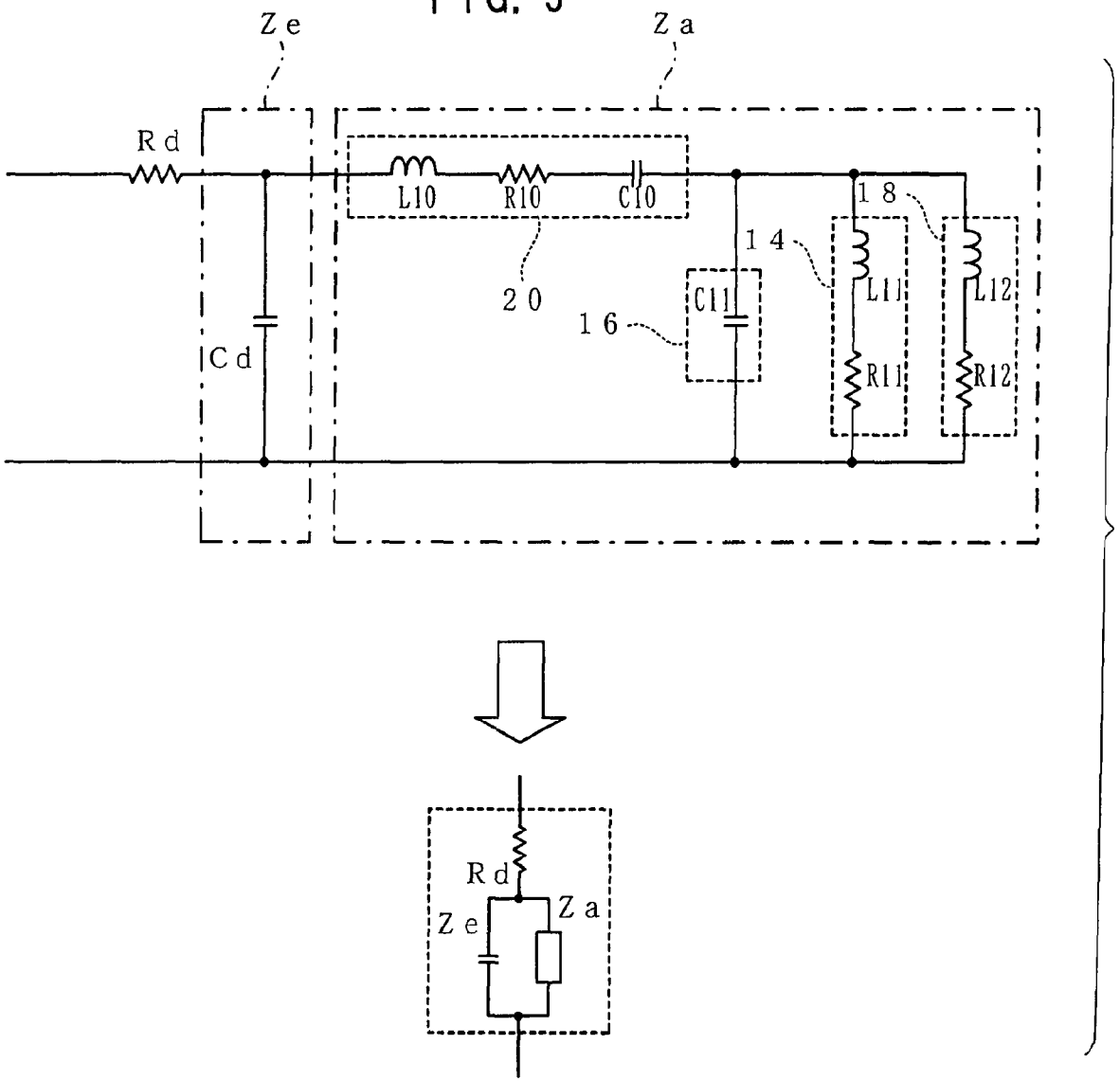
FIG. 5 is a view showing a head equivalent circuit.

The head 10 can be represented in the form of a head equivalent circuit 11 shown in FIG. 5 which comprises an electric-system impedance Ze and an acoustic-system impedance Za. In this case, the following relationship holds between the electric-system impedance Ze and the acoustic-system impedance Za: $|Ze(j\omega)| << |Za(j\omega)|$, where ω is angular frequency, and j is imaginary unit. (Actually, the ratio between the electric system-impedance Ze and the acoustic-system impedance Za is approximately 1:30.) Further, $Rd << |Za(j\omega)|$ The electric-system impedance Ze can be represented by an electrostatic capacitance Cd, and the acoustic-system impedance Za can be represented by an equivalent circuit that corresponds to the pressure chamber 16, the feed passage 14, and the nozzle 18. The piezoelectric element can be represented by a series resonance circuit of an inductance L10, a resistance RI0 and an electrostatic capacitance C10; the pressure chamber 16 by an electrostatic capacitance C11; the feed passage 14 by a series circuit of an inductance L11 and a resistance R11; and the nozzle 18 by a series circuit of an inductance L12 and a resistance R12.

The head equivalent circuit 11 can be regarded as a parallel circuit of the electric-system impedance Ze and the acoustic-system impedance Za as shown in a lower portion of FIG. 5.

Figure 6:
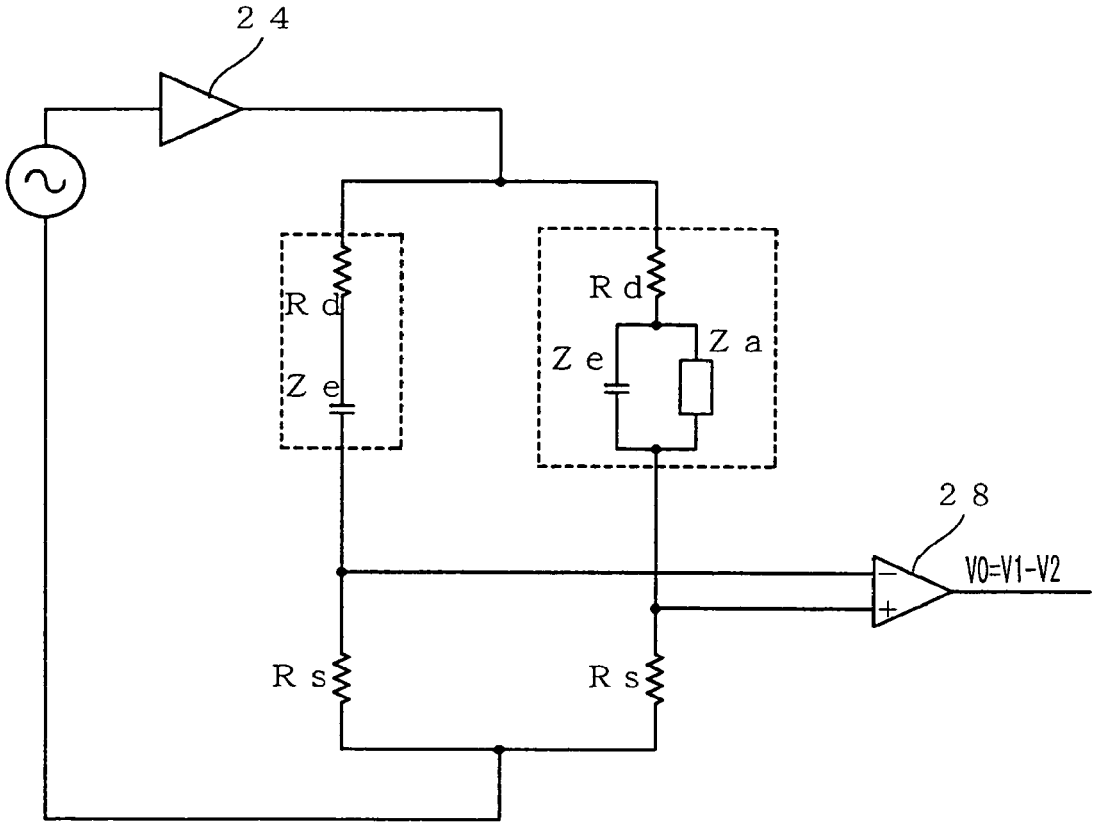
FIG. 6 is a view showing a bridge circuit incorporating the head equivalent circuit shown in FIG. 5.

By using the head equivalent circuit 11, the bridge circuit 26 of the non-ejection detecting circuit 100 according to this embodiment of the present invention can be rewritten as shown in FIG. 6. That is, each head 10 can be substituted with a parallel circuit of the electric-system impedance Ze and the acoustic-system impedance Za. At this point, by adjusting the variable capacitance diode δC by means of the automatic electrostatic capacitance adjustment circuit 30, the capacitor C of the bridge circuit 26 is made to become the electric-system impedance Ze. Assuming that the resistance value of the current detecting resistor Rs is sufficiently small in relation to that of the ON resistance Rd, input voltages V1 and V2 applied to the differential amplifier 28 can be expressed as follows:

$$V1 = \frac{Rs}{Rd + Rs + (Ze // Za)} Vs \approx \frac{Rs}{Rd + (Ze // Za)} Vs$$

$$V2 = \frac{Rs}{Rd + Rs + Ze} Vs \approx \frac{Rs}{Rd + Ze} Vs$$

Since |Ze(jω)|<<|Za(jω)|, Rd<<|Za|, the following expression holds:

$$V_1 = \frac{1}{Rd + \frac{ZeZa}{Ze + Za}} RsVs = \frac{Ze + Za}{Rd(Ze + Za) + ZeZa}$$
$$\approx \frac{Ze + Za}{RdZa + ZeZa} RsVs = \frac{Ze + Za}{(Rd + Ze)Za} RsVs$$

Thus, the following equations are obtained:

$$V1 - V2 = \left(\frac{1}{Rd + Ze} - \frac{Ze + Za}{(Rd + Ze)Za}\right)$$
$$RsVs = \frac{1}{Rd + Ze}\left(1 - \frac{Ze + Za}{Za}\right)RsVs = \frac{Ze}{Rd + Ze}\frac{1}{Za}RsVs$$
$$F(j\omega) = \frac{Ze}{Rd + Ze} = \frac{\frac{1}{j\omega Cd}}{Rd + \frac{1}{j\omega Cd}} = \frac{\frac{1}{CdRd}}{j\omega + \frac{1}{CdRd}}$$

F(jω) represents a low-pass filter which is comprised of the ON resistor Rd and electrostatic capacitor Cd of the nozzle selector circuit.

F(jω) can be regarded to be equal to 1 (unity) since its cut-off frequency is sufficiently higher than the resonance frequency of the acoustic system in question.

Accordingly, the output V0 of the differential amplifier 28 can be expressed as given below, from which it will be seen that the output V0 is proportional to an acoustic-system admittance Ya of the head 10.

$$V1 - V2 \approx \frac{1}{Za} RsVs = YaRsVs$$

Thus, by using the output V0 of the differential amplifier, the resonance frequency of the acoustic vibration system of the head 10 can be obtained as a signal having a high SN ratio.

The operation of the non-ejection detecting circuit 100 will now be described. When ink non-ejection from the head is detected, the switch SWn associated with a nozzle which is an object to be measured is turned on, and the detection of ink non-ejection is carried out on a one-by-one nozzle basis. In this regard, before starting the detection of ink non-injection from each nozzle, the operation switch 32 is turned on to adjust the variable capacitance diode δC.

First, a voltage V1 is applied from the AC voltage source to the drive circuit 24 from which a voltage Vs is then inputted to the bridge circuit 26. Thus, the voltages V2 and V1 are inputted to the differential amplifier 28, and the output V0 of the differential amplifier turns out to be V0=V1−V2. Meanwhile, when the variable capacitance diode δC is adjusted, a signal deviated from the resonance frequency of the piezoelectric element 20 is inputted.

At this point, the output voltage V0 of the differential amplifier 28 is given the following equation (1):

$$V0 = V1 - V2 \propto (C0 + \delta C) - Cd \quad (1)$$

More specifically, the output voltage V0 of the differential amplifier 28 is in phase with the input voltage V1 of the drive circuit 24 when (C0+δC)>Cd, while when (C0+δC)<Cd, the output voltage V0 of the differential amplifier 28 is in reverse phase with the input voltage V1 of the drive circuit 24.

Here, when the operation switch 32 is turned on, the output voltage V0 of the differential amplifier 28 is inputted to the automatic electrostatic capacitance adjustment circuit 30. At this point, if the voltage applied to the variable capacitance diode δC is high, the capacitance of the variable capacitance diode δC is small so that a DC voltage obtained by averaging the output voltage V0 of the differential amplifier 28 turns out to be positive; thus, the voltage applied to the variable capacitance diode δC decreases, and the capacitance thereof increases. In contrast thereto, if the voltage applied to the variable capacitance diode δC is low, the capacitance of the variable capacitance diode δC is great so that a DC voltage obtained by averaging the output voltage V0 of the differential amplifier 28 turns out to be negative; thus, the voltage applied to the variable capacitance diode δC increases, and the capacitance thereof decreases. The above operation will result in the output voltage V0 of the differential amplifier 28 becoming converged to 0 (zero). In this manner, as explained in the above description of the operational principles, the capacitance of the capacitor C can be adjusted so as to be represented by the electric-system impedance Ze of the head 10, and thus the frequency of the acoustic vibration system of the piezoelectric element can be measured using the output voltage V0 of the differential amplifier 28. Consequently, the frequency detecting operation of the frequency detecting unit 38 is performed when the operation switch 32 is turned on.

At the time of the frequency detection, a trapezoidal waveform having rise and fall times that are equal to the natural period of the acoustic vibration system of the head 10 divided by an integer and a cyclic period that is an integer times as long as that of the acoustic vibration system such as illustrated in FIG. 4 is applied as an input signal from the drive circuit 24 to the bridge circuit 26. That is, by inputting a signal containing many higher harmonics to the bridge circuit 26, a damped oscillatory wave having a cyclic period that is equal to the natural period of the acoustic vibration system of the head 10 is outputted from the differential amplifier 28. Accordingly, the cyclic period of the damped oscillatory wave changes between a normal ejection state and a non-ejection state as shown in FIG. 4. Thus, a high-speed detection of ink non-ejection can be achieved by measuring this cyclic period by means of the frequency measuring unit 38.

Figure 7:
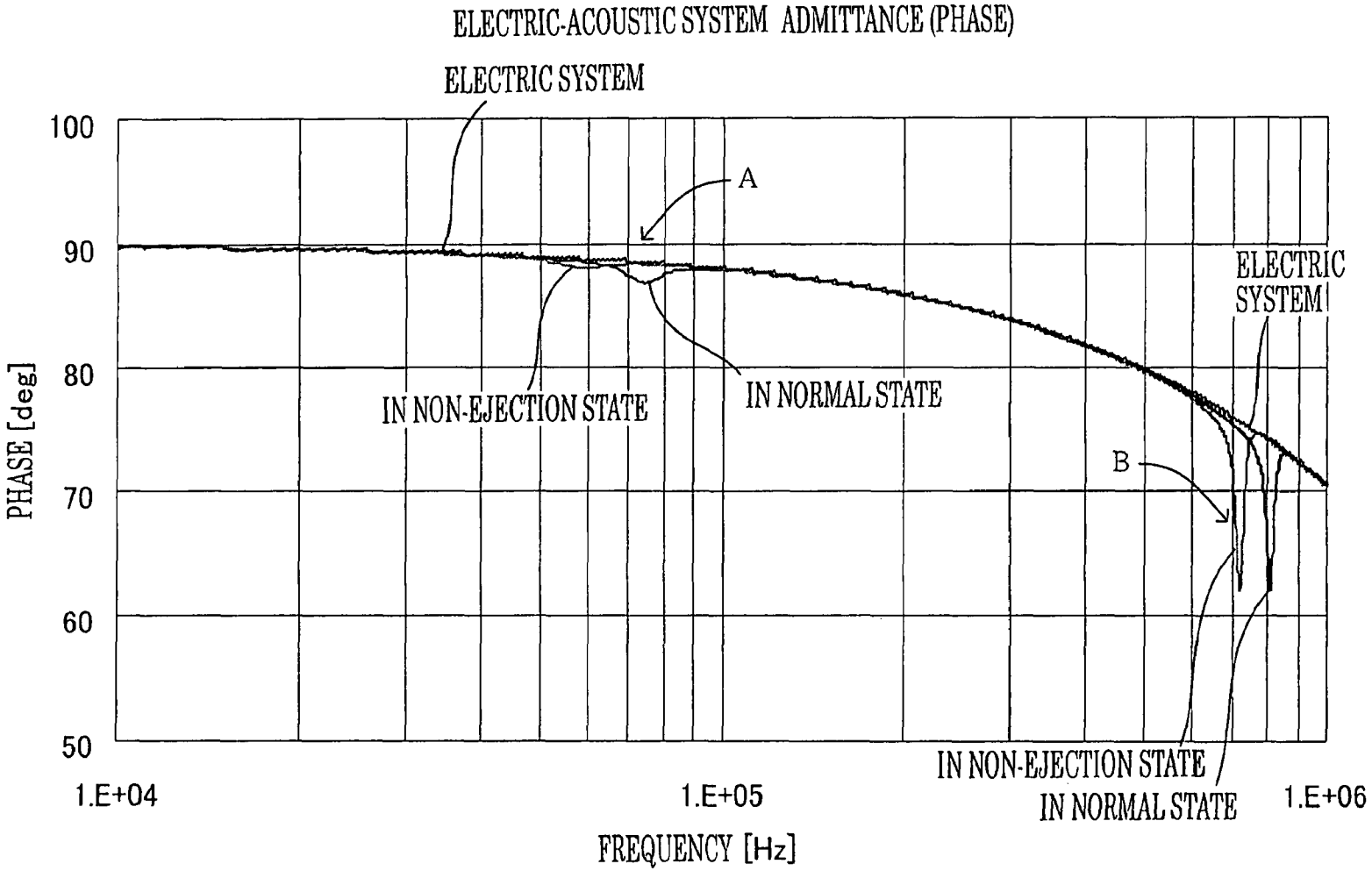
FIG. 7 is a view illustrating the frequency versus phase characteristics of the admittance of the combined electric-acoustic-system in the head.
Figure 8:
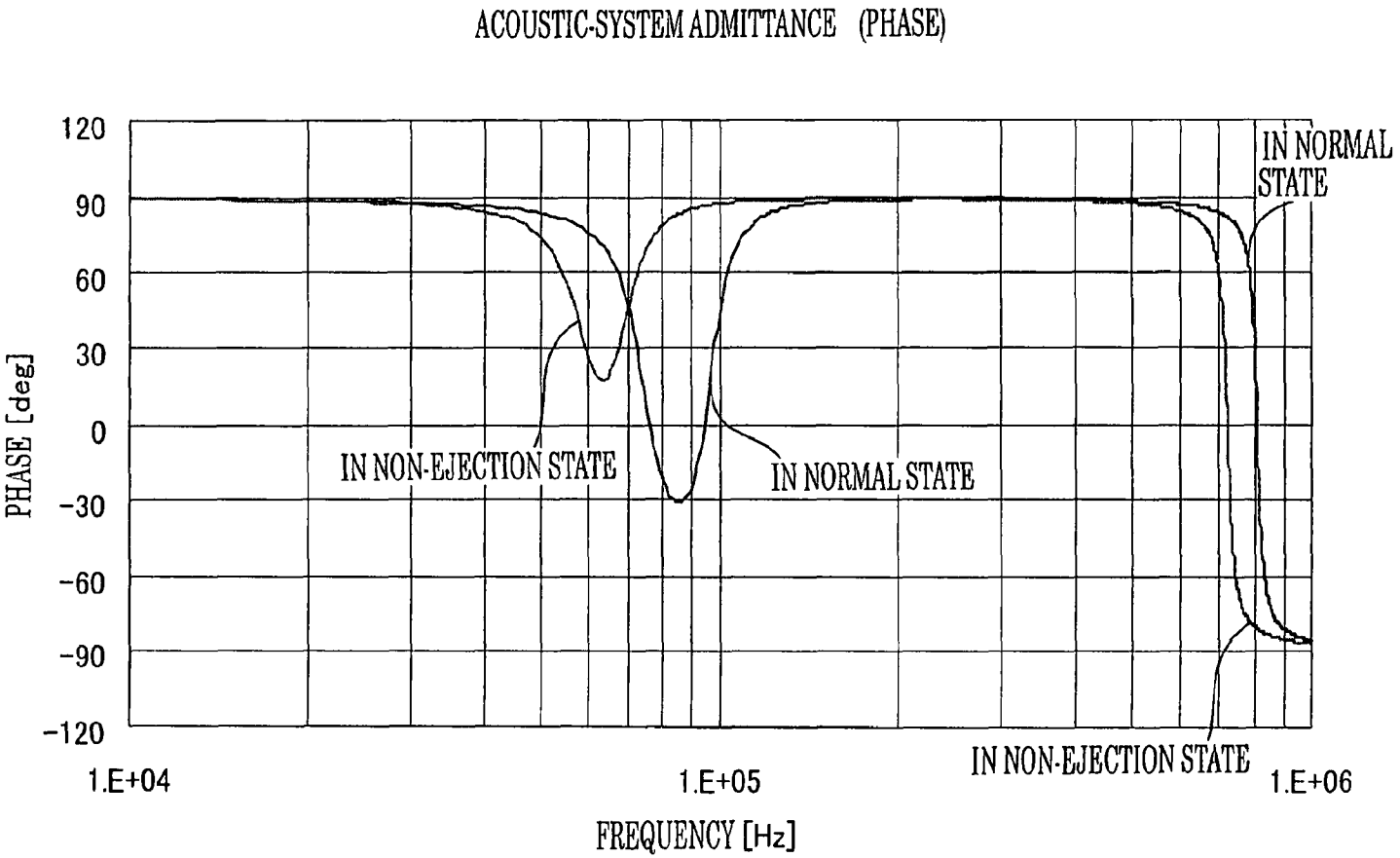
FIG. 8 is a view illustrating the frequency versus phase characteristics of the admittance of the acoustic system when an input signal is inputted to the ink non-ejection detecting circuit for the inkjet recording apparatus according to the first embodiment of the present invention.

FIG. 7 shows the frequency-phase characteristics of the admittance of the combined electric-acoustic system in the head 10. FIG. 8 shows the frequency-phase characteristics of the acoustic system of the head 10 which occur when the above-mentioned input signal is inputted to the ink non-ejection detecting circuit 100 according to this embodiment.

The frequency-phase characteristics of the admittance of the head 10 are greatly influenced by the electric-system admittances (Rd, Cd) as indicated by an arrow A in FIG. 7, and little or no resonance associated with the pressure chamber is observed. Therefore, attempts have conventionally been made to indirectly detect ink non-ejection based on a shift of the resonance point of the piezoelectric element as shown by an arrow B in FIG. 7.

In this embodiment of the present invention, since a signal having a high SN ratio can be obtained through use of the output V0 of the differential amplifier 28, the admittance of the acoustic vibration system can be detected with a high SN ratio as shown in FIG. 8. Thus, by detecting the frequency of the output of the differential amplifier 28 by means of the frequency detecting unit 38, it is possible to detect a nozzle in which ink non-ejection occurs, based on the difference between the frequency in a normal ejection state and the frequency in a non-ejection state.

Figure 9:
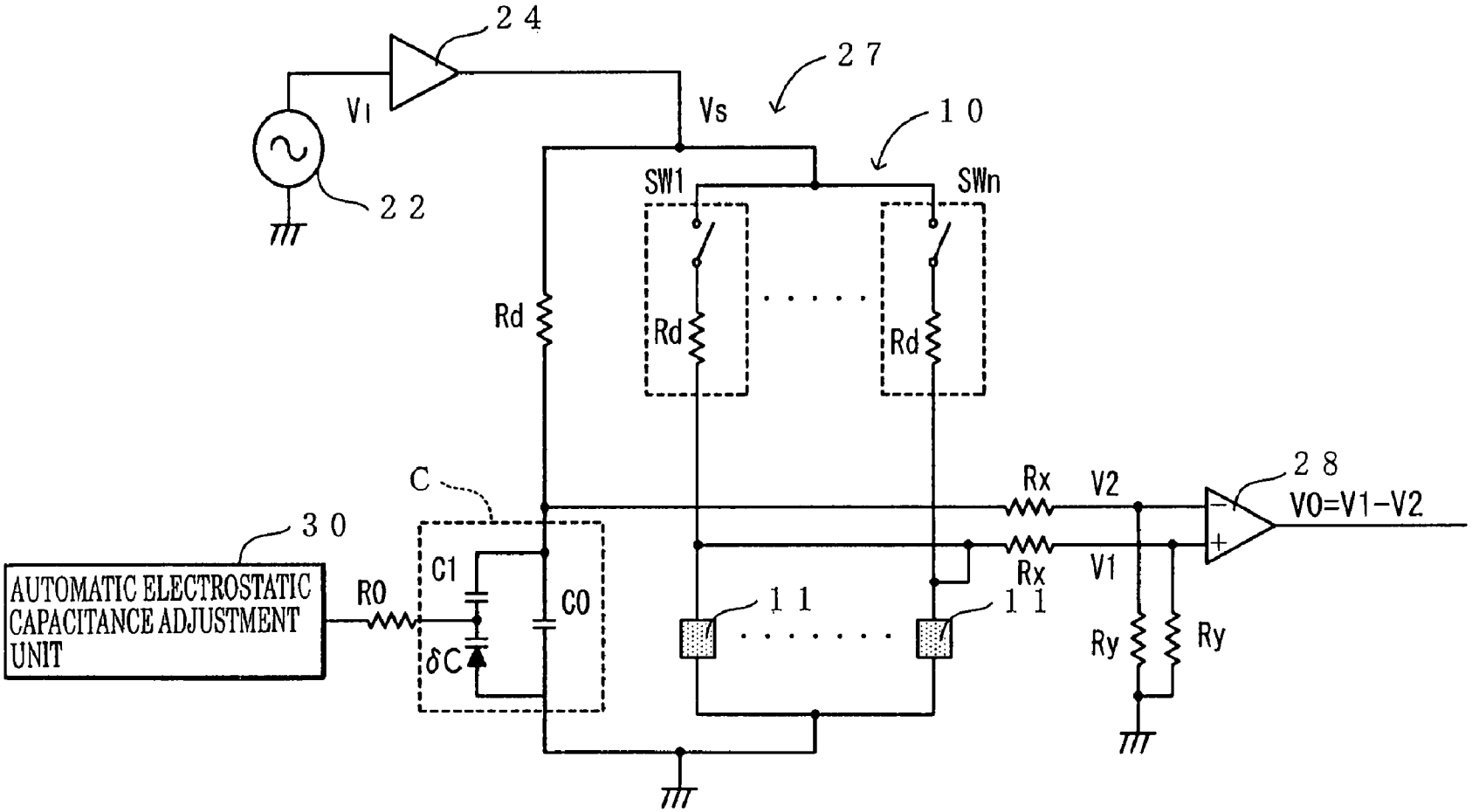
FIG. 9 is a view showing a modified example of the bridge circuit.

A modified example of the bridge circuit 26 incorporated in the ink non-ejection detecting circuit 100 will now be described with reference to FIG. 9 showing such a modified example, wherein parts corresponding to the above-described bridge circuit 26 are indicated by like reference numerals.

As shown in FIG. 9, the modified bridge circuit 27 is connected to the drive circuit 24 as in the above example. The head 10 comprises switches SW1-SWn each comprising an analog multiplexer including an ON resistor Rd for nozzle selection and head equivalent circuits 11 connected in series with the switches SW1-SWn, wherein the series connections of the switches SW1-SWn and the head equivalent circuits 11 are connected in parallel with each other and the number of such series connections is equal to the number of the nozzles.

In the above example, the bridge circuit 26 comprises the head 10 (the ON resistors Rd of the switches SW1-SWn and the head equivalent circuits 11), a current detecting resistor Rs connected in series with the head 10, a resistor Rd identical with the ON resistor and provided outside the head 10, a capacitor C provided outside the head 10 and connected in series with the resistor Rd provided outside the head 10, and a current detecting resistor Rs connected in series with the capacitor C. In the modified example, the bridge circuit 27 comprises the head equivalent circuits 11, the ON resistors Rd of the switches SW1-SWn, the resistor Rd provided outside the head 10 and having the same resistance value as that of the ON resistor Rd, and the capacitor C provided outside the head 10 and connected in series with the resistor Rd.

In the modified example, the drive circuit 24 is connected between the switches SW1-SWn and the resistor Rd of the bridge circuit 27, and the connection point between the head 10 and the capacitor C is grounded.

As in the above example, the capacitor C comprises a variable capacitance diode δC, an electrostatic capacitance component C1 connected in series with the variable capacitance diode δC, and an electrostatic capacitance component C0 connected in parallel with the variable capacitance diode δC. The electrostatic capacitance C1 constitutes a coupling capacitor for preventing a DC voltage applied to the variable capacitance diode δC from flowing into the bridge circuit 27.

Further, the differential amplifier 28 is connected between the switches SW1-SWn and the head equivalent circuits 10 and between the resistor Rd and the capacitor C. In the modified example, a voltage divider circuit is provided which prevents the likelihood that the terminal voltage of the bridge circuit 27 would otherwise become higher than in the above example (by about 30V). More specifically, resistors Rx are connected between the bridge circuit 27 and the differential amplifier 28, and grounded resistors Ry are connected between the resistors Rx and the differential amplifier 28. Thus, the differential amplifier 28 can be operated as in the above example.

As in the above example, the output of the differential amplifier 28 is inputted to the automatic electrostatic capacitance adjustment circuit 30, the output of which in turn is connected to the connection point between the electrostatic capacitance C1 of the capacitor C and the variable capacitance diode δC via the resistor R0. The automatic electrostatic capacitance adjustment circuit 30 is arranged as in the above example, and therefore further description thereof is omitted. Although not shown in FIG. 9, the frequency detecting unit 38 is connected to the output of the differential amplifier 28 via the band-pass filter 36 as in the above example.

The use of the bridge circuit 27 having the above structure also enables the ink non-ejection detecting circuit 100 to operate in a manner similar to that described above.

Figure 10:
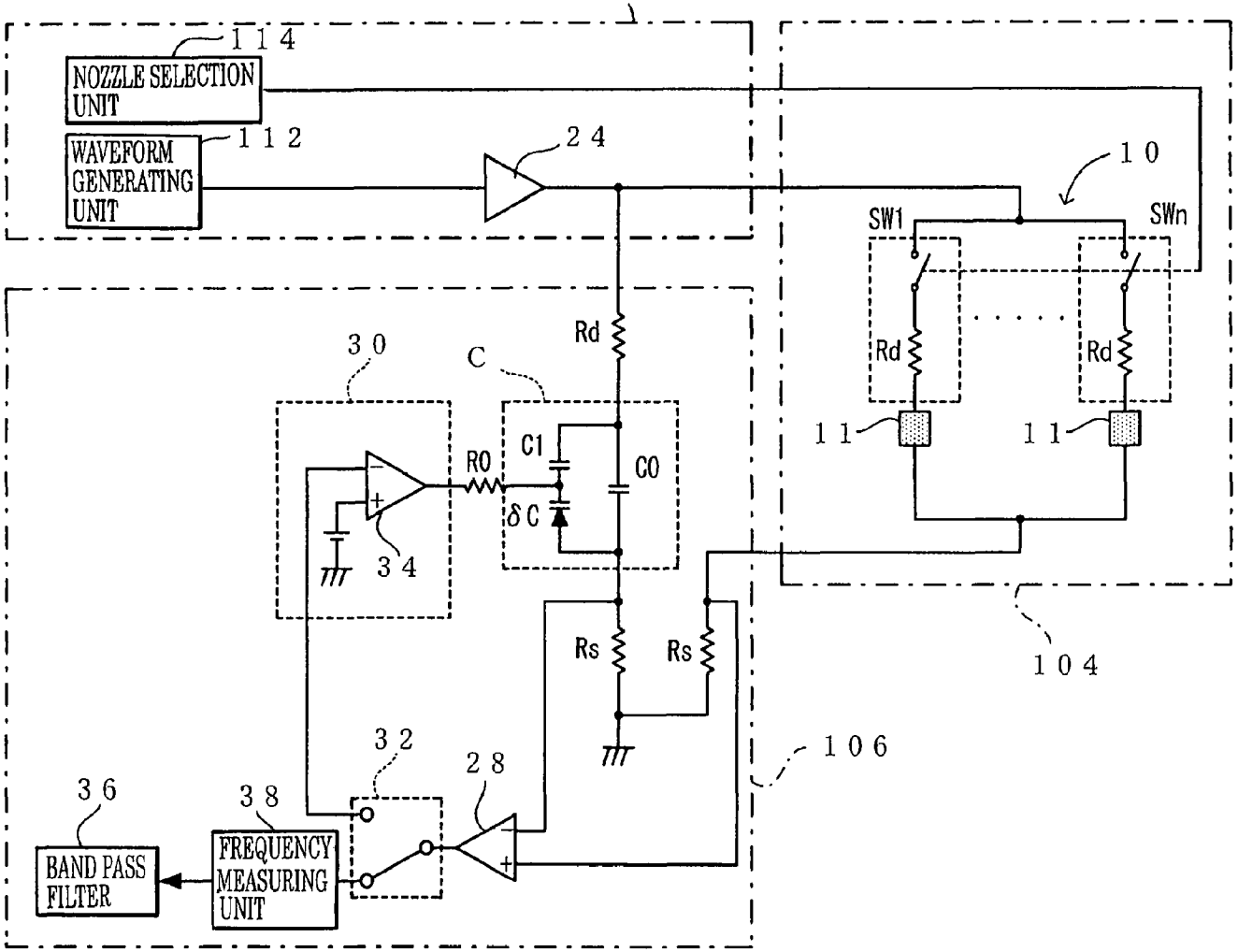
FIG. 10 is a view showing an example wherein the ink non-ejection detecting circuit according to the first embodiment of the present invention is incorporated in the inkjet recording apparatus.

As shown in FIG. 10, the ink non-ejection detecting circuit 100 can be incorporated in an inkjet recording apparatus.

When incorporated in an inkjet recording apparatus 110, the ink non-ejection detecting circuit 100 comprises a drive section 102, a head assembly 104, and an ink non-ejection detecting section 106.

The drive section 102 comprises a drive signal generating circuit 112, the above drive circuit 24, and a nozzle selection unit 114.

The drive signal generating circuit 112 generates a drive signal for permitting the head 10 to eject ink so as to record an image and the above-mentioned trapezoidal waveform for detecting occurrence of ink non-ejection. The drive circuit 24 amplifies and supplies the power of the drive signal generated by the drive signal generating circuit 112 to the head 10.

The nozzle selection circuit 114 controls the on/off operation of the switches SW1-SWn of the head 10 and selects nozzles that are enabled to eject inks when an image is recorded. The nozzle selection circuit 114 also selects nozzles that are subjected to detection of ink non-ejection when ink non-ejection is detected.

The head assembly 104 comprises the above-described head 10 wherein the drive signal is selectively inputted to the switches SW1-SWn thereby permitting ink to be ejected. Differently stated, the switches SW1-SWn are selectively controlled by the nozzle selection circuit 114, thereby permitting an image to be recorded.

The ink non-ejection detecting section 106 extracts the resonance information of the acoustic system of the head 10 as a damped oscillatory wave based on a difference between the current from the drive section 102 and the current from the head assembly 104, thereby detecting occurrence of ink non-ejection in accordance with a change in the frequency of the damped oscillatory wave.

The ink non-ejection detecting section 106 comprises the two current detecting resistors Rs, resistor Rd and capacitor C of the bridge circuit 26. The ink non-ejecting detecting section 106 further comprises the differential amplifier 28, the automatic electrostatic capacitance adjustment circuit 30, the operation switch 32, the band-pass filter 36, and the frequency measuring unit 38. Meanwhile, it is arranged such that the operation switch 32 is switched to the automatic electrostatic capacitance adjustment circuit 30 when adjusting the electrostatic capacitance and to the band-pass filter 36 when measuring the frequency.

With the foregoing construction, the above-described ink non-ejection detecting circuit 100 can be incorporated in the inkjet recording apparatus 110.

Figure 11:
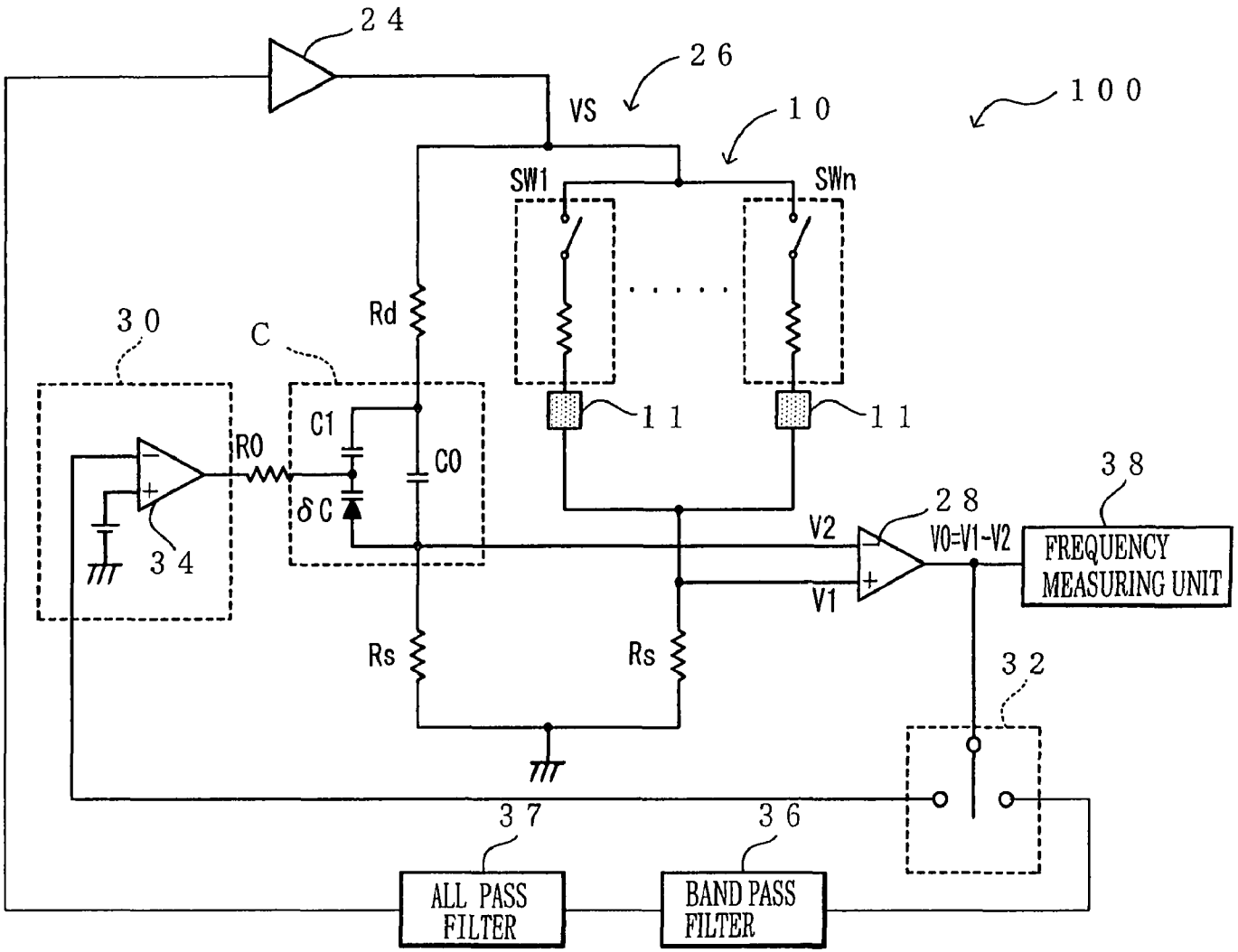
FIG. 11 is a diagrammatic view showing the ink non-ejection detecting circuit for an inkjet recording apparatus according to a second embodiment of the present invention.

FIG. 11 shows the ink non-ejection detecting circuit for an inkjet recording apparatus according to a second embodiment of the present invention, wherein parts corresponding to those of the first embodiment shown in FIG. 2 are indicated by like reference numerals and symbols and further description thereof is omitted. The arrangement shown in FIG. 11 is similar to the arrangement of FIG. 2 except that the operation switch 32 comprises an operation change-over switch, that the frequency measuring unit 38 is connected to the output of the differential amplifier 28, that the band-pass filter 36 is connected to the connection point between the differential amplifier 28 and the frequency measuring unit 38 via the operation change-over switch 32 and to a all-pass filter 37, and that the all-pass filter 37 is connected to the input of the drive circuit It will be appreciated that what has been illustrated and described with reference to FIGS. 1 to 10 is applicable to the embodiments of the present invention which will be illustrated and described with reference to FIGS. 11 to 14, where appropriate.

An operation change-over switch 32 is connected to the drive circuit 24 via the band-pass filter 36 and a all-pass filter 37, constitutes a positive feedback circuit through the band-pass filter 36 and all-pass filter 37.

The band-pass filter 36 may be comprised of a band-pass filter that passes a frequency band including the resonance frequency of the acoustic system of the head 10. It is also possible that a low-pass filter may be used in lieu of such a band-pass filter.

Figure 12:
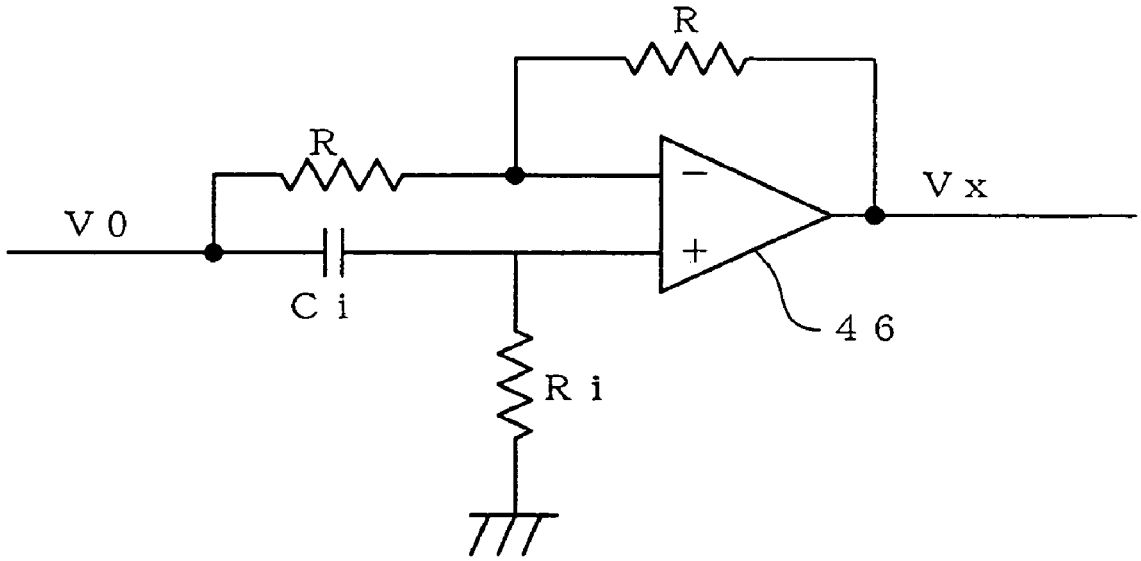
FIG. 12 is a view showing an example of all-pass filter.

FIG. 12 shows an example of the all-pass filter 37. The all-pass filter 37 is a filter for changing only phase, wherein the output of the differential amplifier 28 is inputted to a positive terminal of an amplifier 46 via a capacitor Ci. The positive terminal of the amplifier 46 is grounded via a resistor Ri.

Further, the amplifier 46 has a negative terminal connected to the output of the differential amplifier 28 via a resistor R and also connected to the output terminal of the amplifier 46 via a resistor R.

The constants of the all-pass filter 37 are set such that the voltage gain is higher than or equal to 1 (unity) in the loop comprising the drive circuit 24, the bridge circuit 26, the differential amplifier 28, and the positive feedback circuit (the band-pass filter 36 and all-pass filter 37) and the phase difference is 0 in an open loop.

When the operation change-over switch 32 is switched to the positive feedback circuit, the differential voltage V0 outputted from the differential amplifier 28 is applied to the band-pass filter 36, and thus only the frequency band including the resonance frequency of the acoustic system of the head 10 is passed to the all-pass filter 37.

The transfer characteristics of the all-pass filter 37 will now be described.

The transfer characteristics of the all-pass filter 37 can be expressed by the following equation:

$$H(j\omega) = \frac{Vx(j\omega)}{V0(j\omega)} = \frac{j\omega - \omega 0}{j\omega + \omega 0}$$

$$\omega 0 = \frac{1}{CiRi}$$

The gain characteristics of the all-pass filter 37 can be expressed by the following equation from which it will be noted that the gain is constant at any frequency:

$$|H(j\omega)|^2 = H(j\omega)H(-j\omega) = \frac{j\omega - \omega 0 - j\omega - \omega 0}{j\omega + \omega 0 - j\omega + \omega 0} = 1$$

The phase characteristics of the all-pass filter 37 can be expressed by the following equation from which it will be seen that the phase characteristics are rotated from 0 degrees to −180 degrees:

$$\arg H(j\omega) = -2\arctan\frac{\omega}{\omega 0}$$

Figure 13:
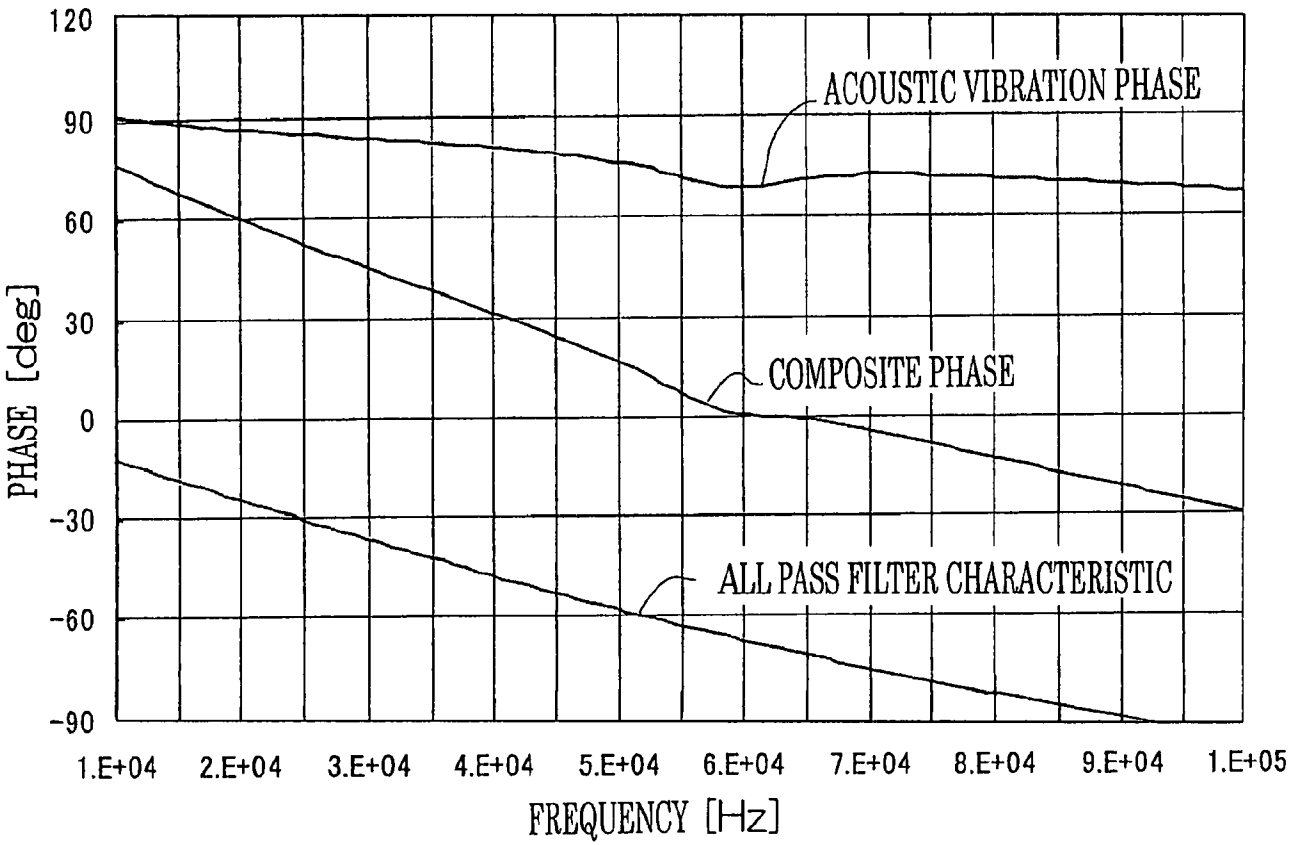
FIG. 13 is a view illustrating the frequency versus phase characteristics of the acoustic system of the head shown in FIG. 11.

FIG. 13 shows an example of the acoustic system phase characteristics of the head 10 in which a small low peak occurs in the neighborhood of 60 kHz and the phase at the low peak is about +70 degrees. In this embodiment, such all-pass filter characteristics as shown in FIG. 13 are realized by suitably choosing the constants of the all-pass filter 37.

As a result, the phase difference when the head 10 and the all-pass filter 37 are connected in series with each other is 0 (zero) in the neighborhood of 60 kHz as shown by a composite phase curve in FIG. 13.

In this manner, a signal outputted from the differential amplifier can be caused to oscillate with the above-mentioned frequency (the resonance frequency of the acoustic vibration system of the head 10). Thus, by measuring the oscillation frequency and/or detecting the oscillation by means of the frequency measuring unit 38, it is possible to determine that an ink non-ejection state has occurred when the frequency is out of conformity with the oscillation frequency beforehand or when no oscillation occurs. In this manner, a high-speed detection of ink non-ejection can be achieved in a short period of time.

The band-pass filter 36 limits the frequency which is enabled to pass therethrough, thereby preventing oscillation from occurring at a frequency other than the above-mentioned oscillation frequency.

The frequency-phase characteristics of the admittance of the head 10 are greatly influenced by the electric-system admittances (Rd, Cd) as indicated by an arrow A in FIG. 7, and little or no resonance associated with the pressure chamber is observed. Therefore, attempts have conventionally been made to indirectly detect ink non-ejection based on a shift of the resonance point of the piezoelectric element as shown by an arrow B in FIG. 7.

In this embodiment, as described above, a signal having a high SN ratio can be obtained using the output V0 of the differential amplifier 28, and an oscillation is enabled to occur at the resonance frequency of the acoustic vibration system of the head 10. Thus, it is possible to detect, with a high SN ratio, the admittance of the acoustic vibration system of the head 10, as shown in FIG. 8. Further, since an oscillation occurs at a zero cross point where the phase difference is 0 (zero) degrees, it is possible to detect an ink non-ejection state of a nozzle by detecting when no oscillation is present or when the oscillation ceases by means of the frequency detecting unit 38. In this manner, a nozzle in which ink non-ejection occurs can be detected in a short period of time by detecting the resonance frequency of the admittance of the acoustic vibration system of the head 10. Although in this embodiment, a nozzle in which ink non-ejection occurs is detected by detecting whether or not an oscillation is present, it is also possible to detect such a nozzle by detecting a change in the oscillation frequency by means of the frequency measuring unit 38.

As in the first embodiment of the present invention, the output of the differential amplifier 28 is inputted to the automatic electrostatic capacitance adjustment circuit 30, and the output of the automatic electrostatic capacitance adjustment circuit 30 is connected to the connection point between the electrostatic capacitance C1 of the above-mentioned capacitor C and the variable capacitance diode δC via the resistor R0. The automatic electrostatic capacitance adjustment circuit 30 has the same structure as that of the first embodiment according to the present invention, and therefore further description thereof is omitted. Although not shown in FIG. 9, as in the foregoing first embodiment the frequency detecting unit 38 is connected to the output of the differential amplifier 28, and the positive feedback circuit (the band-pass filter 36 and all-pass filter 37) is connected thereto via the operation switch 32.

Figure 14:
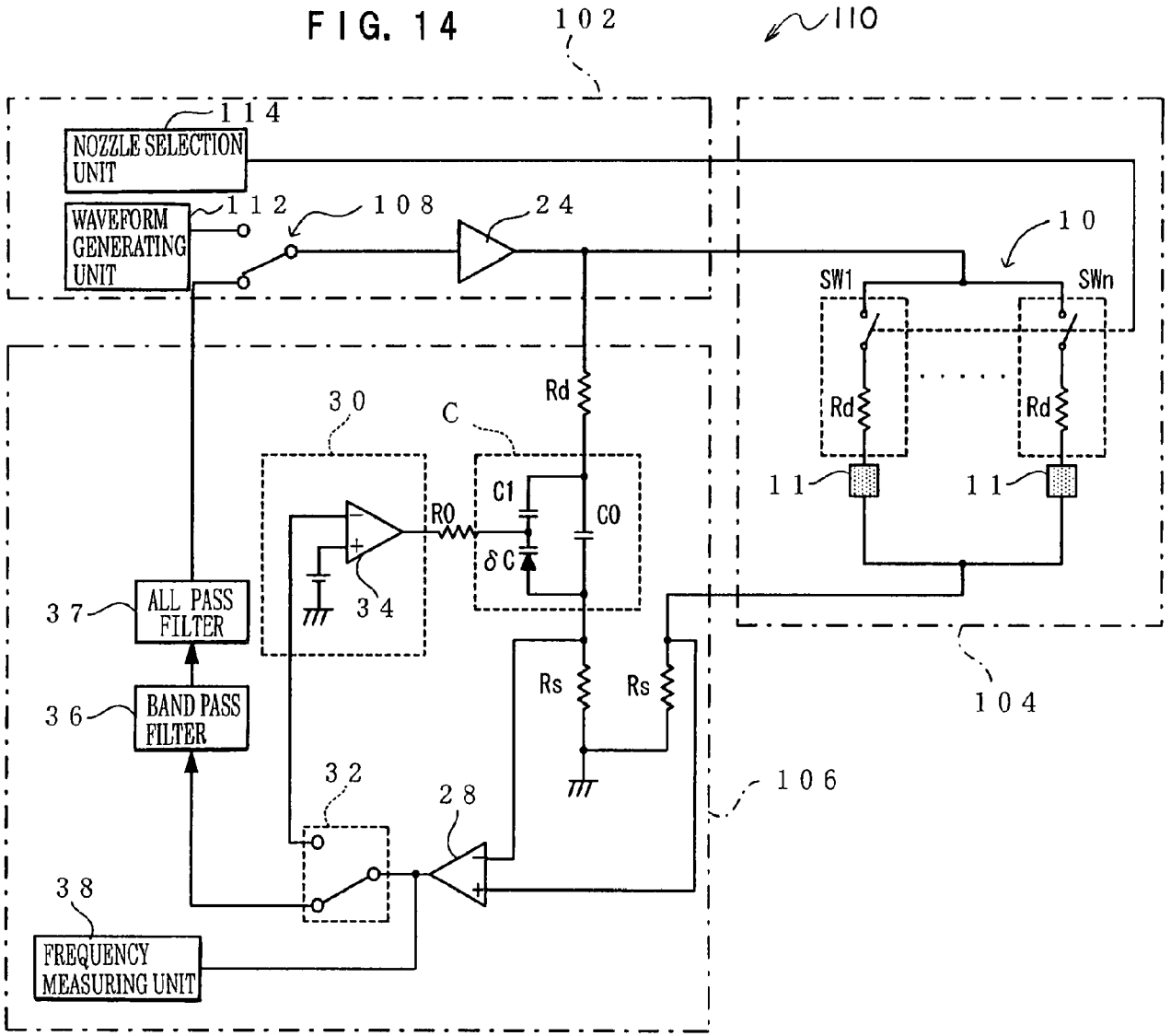
FIG. 14 is a view showing an example wherein the ink non-ejection detecting circuit according to the second embodiment of the present invention is incorporated in the inkjet recording apparatus.

As shown in FIG. 14, the ink non-ejection detecting circuit 100 can be incorporated in an inkjet recording apparatus.

When incorporated in an inkjet recording apparatus 110, the ink non-ejection detecting circuit 100 comprises a drive section 102, a head assembly 104, and an ink non-ejection detecting section 106.

The drive section 102 comprises a waveform generating circuit 112, the above-described drive circuit 24, an operation change-over switch 108, and a nozzle selection unit 114.

The waveform generating circuit 112 generates a drive signal for permitting the head 10 to eject ink so as to record an image. The drive circuit 24 amplifies and supplies the power of the drive signal generated by the waveform generating circuit 112 to the head 10.

The nozzle selection unit 114 controls the on/off operation of the switches SW1-SWn of the head 10 and selects nozzles that are enabled to eject ink when an image is recorded. The nozzle selection unit 114 also selects nozzles that are subjected to detection of ink non-ejection when ink non-ejection is detected.

Further, the operation change-over switch 108 switches so as to input a drive signal generated by the waveform generating circuit 112 to the drive circuit 24 when an image is recorded. The operation change-over switch 108 also switches so as to input a signal derived from the all-pass filter 37 of the above-mentioned positive feedback circuit to the drive circuit 24.

The head assembly 104 comprises the above-described head 10 wherein the drive signal is selectively inputted to the switches SW1-SWn thereby permitting ink to be ejected. Differently stated, the switches SW1-SWn are selectively controlled by the nozzle selection circuit 114, thereby permitting an image to be recorded.

The ink non-ejection detecting section 106 constitutes a positive feedback circuit together with the drive section 102 and head assembly 104 and detects non-ejection of ink from the nozzles based on a change in the oscillation frequency or based on whether or not oscillation is present.

The ink non-ejection detecting section 106 comprises the two current detecting resistors Rs, resistor Rd and capacitor C of the bridge circuit 26. The ink non-ejecting detecting section 106 further comprises the differential amplifier 28, the automatic electrostatic capacitance adjustment circuit 30, the operation switch 32, the band-pass filter 36, and the frequency measuring unit 38.

With the foregoing construction, the above-described ink non-ejection detecting circuit 100 can be incorporated in the inkjet recording apparatus 110.

While the present invention has been illustrated and described with respect to specific embodiments thereof, it is to be understood that the present invention is by no means limited thereto, and encompasses all changes and modifications which will become possible without departing from the spirit and scope of the present invention.

What is claimed is:

1. An ink non-ejection detecting circuit for an inkjet recording apparatus, comprising:

a bridge circuit including a piezoelectric head having a piezoelectric element, a first resistor connected in series with the piezoelectric head, a capacitor provided outside the piezoelectric head, and a second resistor connected in series with the capacitor;

a differential amplifier circuit that amplifies a differential voltage appearing between the piezoelectric head and the first resistor and between the capacitor and the second resistor; and a positive feedback circuit that adjusts a phase of the differential voltage so as to make null a phase difference between a signal for driving the bridge circuit and the differential voltage amplified by the differential amplifier circuit, thereby generating a driving signal for the bridge circuit.

2. The ink non-ejection detecting circuit according to claim 1, further comprising a frequency detecting circuit that detects an oscillation frequency derived from the differential amplifier circuit when the bridge circuit is driven by the driving signal generated by the positive feedback circuit.

3. The ink non-ejection detecting circuit according to claim 2, wherein the capacitor includes a variable element with a capacitance that is electrically variable, further comprising an adjustment circuit that adjusts the capacitance of the variable element to minimize the differential voltage amplified by the differential amplifier circuit.

4. The ink non-ejection detecting circuit according to claim 1, wherein the capacitor includes a variable element with a capacitance that is electrically variable, further comprising an adjustment circuit that adjusts the capacitance of the variable element to minimize the differential voltage amplified by the differential amplifier circuit.

5. An inkjet recording apparatus wherein ink is ejected from a piezoelectric head having a piezoelectric element by inputting a driving signal to the piezoelectric head thereby recording an image, the apparatus comprising the ink non-ejection detecting circuit according to claim 1.

6. A method for checking an inkjet recording apparatus wherein ink is ejected from a piezoelectric head having a piezoelectric element, the method comprising:

forming a bridge circuit including the piezoelectric head having the piezoelectric element, a first resistor connected in series with the piezoelectric head, a capacitor provided outside the piezoelectric head, and a second resistor connected in series with the capacitor;

forming a differential amplifier circuit that amplifies a differential voltage appearing between the piezoelectric head and the first resistor and between the capacitor and the second resistor in the bridge circuit;

forming a positive feedback circuit that adjusts a phase of the differential voltage so as to make null a phase difference between a signal for driving the bridge circuit and the differential voltage; and using a signal generated by the positive feedback circuit as a driving signal for the bridge circuit.

7. The method according to claim 6, further comprising detecting an oscillation frequency derived from the differential amplifier circuit when the bridge circuit is driven by the driving signal.

8. The method according to claim 7, wherein the capacitor includes a variable element with a capacitance that is electrically variable, the method further comprising; adjusting the capacitance of the variable element so as to minimize the differential voltage amplified by the differential amplifier circuit; and thereafter inputting the driving signal to the bridge circuit.

9. The method according to claim 6, wherein the capacitor includes a variable element with a capacitance that is electrically variable, the method further comprising; adjusting the capacitance of the variable element so as to minimize the differential voltage amplified by the differential amplifier circuit; and thereafter inputting the driving signal to the bridge circuit.

* * * * *